US007415960B2

(12) United States Patent
Snyder et al.

(10) Patent No.: US 7,415,960 B2
(45) Date of Patent: Aug. 26, 2008

(54) ENGINE FLUID PASSAGE INTERSECTION AND METHOD

(75) Inventors: W. Bryan Snyder, Westland, MI (US); Robert Z. Olszewski, Glen Ellyn, IL (US); Martin R. Zielke, Lockport, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 95 days.

(21) Appl. No.: 11/463,167

(22) Filed: Aug. 8, 2006

(65) Prior Publication Data

US 2008/0035100 A1 Feb. 14, 2008

(51) Int. Cl.
*F02B 75/22* (2006.01)
*F01M 1/02* (2006.01)

(52) U.S. Cl. ..... 123/195 R; 123/196 R

(58) Field of Classification Search ..... 123/195 R, 123/196 R; 29/888.01
See application file for complete search history.

(56) References Cited

U.S. PATENT DOCUMENTS

| | | | | |
|---|---|---|---|---|
| 3,805,874 | A * | 4/1974 | Wahlqvist | 164/132 |
| 5,445,210 | A * | 8/1995 | Brassell | 164/369 |
| 5,870,991 | A * | 2/1999 | Mineno | 123/196 R |
| 6,530,356 | B2 * | 3/2003 | Inoue et al. | 123/196 R |

FOREIGN PATENT DOCUMENTS

JP 2004169591 A * 6/2004

* cited by examiner

*Primary Examiner*—Noah Kamen
(74) *Attorney, Agent, or Firm*—Jack D. Nimz; Jeffrey P. Calfa

(57) ABSTRACT

A fluid passage intersection (314) within a component (100) includes a supply passage (118) formed in the component (100), a cavity (316) in fluid communication with the supply passage (118), and at least one outlet passage (326) formed in the component (100) that is in fluid communication with the cavity (316).

3 Claims, 3 Drawing Sheets

ENGINE FLUID PASSAGE INTERSECTION AND METHOD

FIELD OF THE INVENTION

This invention relates to internal combustion engines, including but not limited to fluid passages in a crankcase of an internal combustion engine.

BACKGROUND OF THE INVENTION

Internal combustion engines include crankcases having a plurality of cylinders. The cylinders contain pistons whose reciprocating motion due to combustion events may be transferred through a crankshaft to yield a torque output of the engine. Often, engine crankcases are made of cast metal, and include passages integrally formed therein for the transfer of various fluids from one location of the engine to another. Fluids typically transferred through passages in an engine include coolant, air, fuel, oil, and so forth.

One known method of transferring fluid through an engine component, such as a crankcase, includes casting-in passages and/or drilling through material of the casting to create passages. In some engines, these passages may need to span an entire length of the engine, and the fluid they may carry during operation of the engine may be distributed to many other engine components.

Any method used to create passages in an engine component for the transfer of fluid may have design limitations associated therewith. For example, cast-in passages are advantageous in that they may be formed concurrently with a casting operation of the engine component, but are limited in their location and size because they are formed by the same mold that is used to form the engine component itself. In the case of a crankcase, passages cast in the crankcase may contain debris after the casting operation is complete, and are thus limited to locations that are capable of being cleaned, especially if these passages are used for critical fluid transfer, for example fuel or oil.

Similarly, drilled passages are advantageous in that they may be easily cleaned after a drilling operation, but they are disadvantageously time consuming and relatively expensive to create because they require a dedicated machining operation. Moreover, in the case when passages intersect within the engine component, a drilling operation used to create these passages may become even more complicated and time consuming.

Accordingly, there is a need for an improved fluid passage configuration for transferring fluid in an engine that includes intersecting passages and that is not complicated and time consuming to implement.

SUMMARY OF THE INVENTION

A crankcase for an internal combustion engine includes an integrated oil passage formed therein having a plurality of distribution passages fluidly connected thereto. A cavity is also formed therein that is in fluid communication with the integrated oil passage. At least two of the plurality of distribution passages are fluidly connected to the integrated oil passage through the cavity. The cavity is an open cavity that is formed during a casting operation used to form the crankcase.

DESCRIPTION OF A PREFERRED EMBODIMENT

The following describes an apparatus for and method of intersecting fluid passages within a component of an engine. An oil passage within an engine crankcase is used herein for illustration, but creation of passages that transfer other fluids to, from, or through other engine components may advantageously be used.

A typical crankcase for an engine may include fluid passages integrated therein. An oil passage, for example, may distribute oil to a number of engine components for use as an actuation or lubrication medium. A typical fluid passage may have a main supply passage connected to a pump that branches out to various locations. Typical passages integrated in a crankcase are either cast or drilled in place, and include intersections to communicate to each other. A typical intersection between passages may be formed by the coincidence of blindly drilled holes. Such intersections pose challenges in that they create wear in the tooling used to drill the passages, and also in that most are drilled blind. These and other challenges may be overcome by casting one or more intersection cavities in the crankcase to provide easy and open access to endpoints of fluid passages that are integrated with the crankcase. A fluid passage intersection within a component in accordance with the invention may include a supply passage formed in the component, a cavity in fluid communication with the supply passage, and at least one outlet passage formed in the component that is in fluid communication with the cavity.

Figure 1:
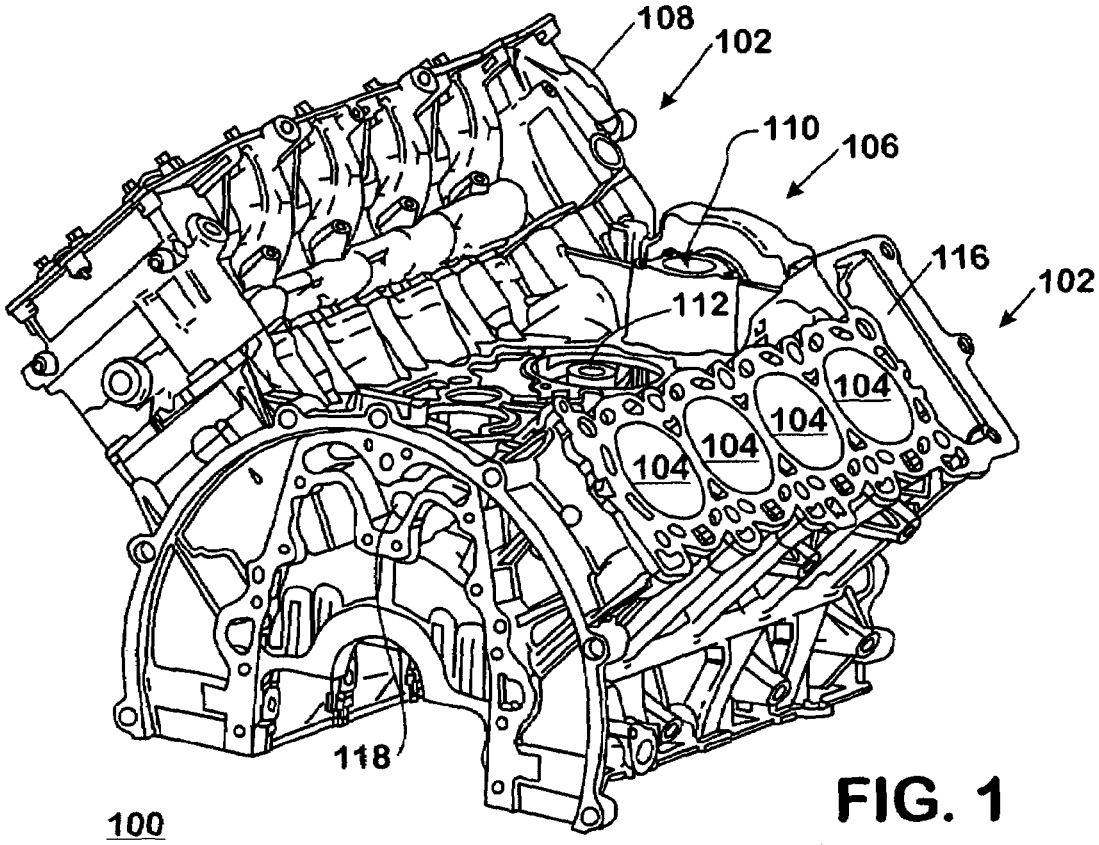
FIG. 1 is an outline view of an engine crankcase having an integrated oil distribution system formed therein in accordance with the invention.

An outline of a crankcase 100 for an engine is shown in FIG. 1. The crankcase 100 shown is a crankcase for an eight (8) cylinder engine having a "V" configuration. Two banks 102 each having four (4) cylinders 104 are oppositely located on either side of the crankcase 100 along its entire length. The cylinder banks 102 are connected to a valley structure 106 occupying a central portion of the crankcase 100. A cylinder head 108 is shown attached to the crankcase 100 on one of the cylinder banks 102. The cylinder head 108 may include additional engine components (not shown) such as fuel injectors, intake and exhaust valves, over-head camshafts, and so forth. The crankcase 100 may also include a number of different integrated passages and/or cavities. For example, a coolant passage 110, a turbocharger oil supply passage 112, a timing chain cavity 116, and others, may be formed in the crankcase 100.

A central oil supply passage 118 may be drilled through an entire length of the valley structure 106 of the crankcase 100. An operation commonly referred to as "gun drilling" may be used to form the passage 188 by drilling a long opening through a metal body of the crankcase 100. The passage 118 may be used to transfer oil or another fluid from one end of the crankcase 100 to another. The oil in the passage 118 may be used for various purposes during operation of an engine, for example, for lubrication of various engine components, for actuation of fuel injectors, for lubrication and/or actuation of an overhead cam structure, and others. Typically, oil from the passage 118 may be distributed to other passages.

Figure 2:
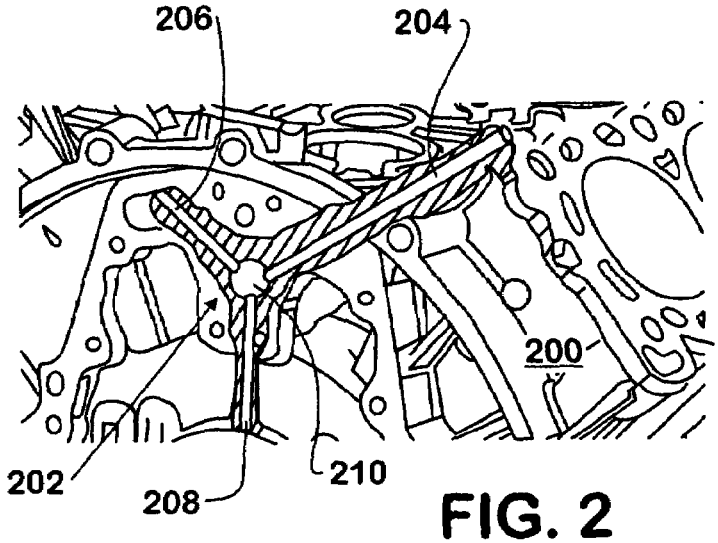
FIG. 2 PRIOR ART
FIG. 2 is a detail cross-section view of a fluid passage intersection having blind drilled passages.

A known configuration of a crankcase 200 having a fluid passage intersection 202 is shown in partial cross section in FIG. 2. The intersection 202 may fluidly connect a right-bank fluid passage 204, a left-bank fluid passage 206, and a rear-bearing passage 208 with a supply passage 210. The supply passage 210 may be drilled through an entire length along a valley structure 212 of the crankcase 200 as described above. Each of the passages 204, 206, and 208 may be used to lubricate and/or supply various other engine components. The intersection 202 may be formed by the net result of drilling operations used to form each of the passages 204, 206, and 208. For example, a drill (not shown) may form the supply passage 210. Additional drilling operations may be used to form each of the passages 204, 206, and 208 and may be arranged to coincide at the supply passage 210. A point where each drilling operation used to create each passage may be the intersection 202.

There are many disadvantages with such a formation of the intersection 202. First, all or most drilling operations used to form each passage 204, 206, and 208 are "blind", meaning that a drilling location and depth must be controlled to ensure a proper location of the drill and depth of the drilling operation because the intersection 202 is internal to the crankcase 200 and not externally visible. Second, any misalignment of the drills used to form each passage 204, 206, and 208 may either fail to accomplish a proper formation of the intersection 202 if gross, or alternatively may introduce sharp edges and reductions in flow area of each passage 204, 206, and 208. Such reductions if flow area may disadvantageously increase a pressure drop in the flow of fluid. Third, wear on the tooling used to drill each passage is increased due to the increased extent of drilling required to complete each crankcase 200. These and other disadvantages may be avoided, or their effect lessened, by use of an intersection configuration as described below.

Figure 3:
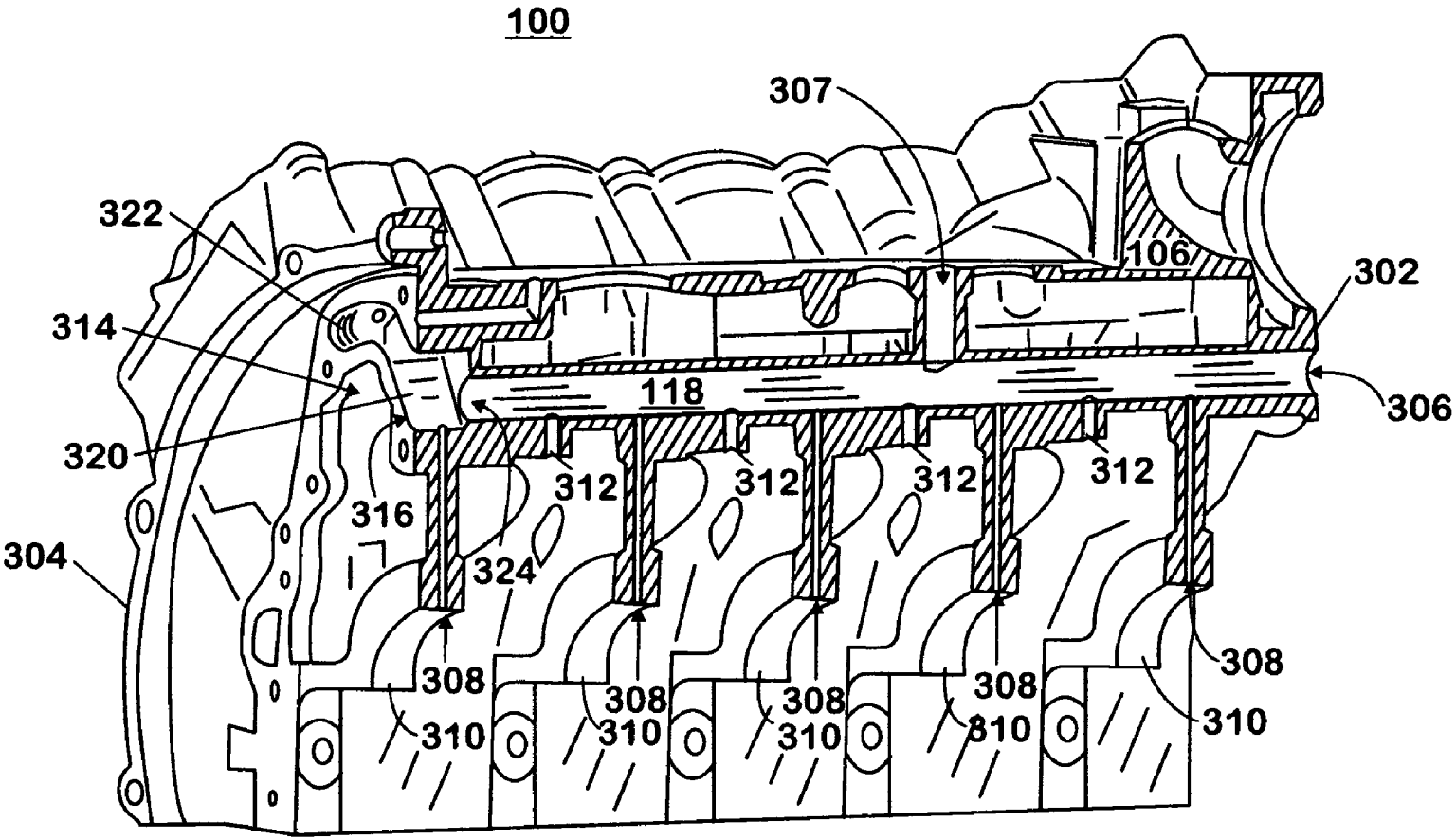
FIG. 3 is a cross-section view of the crankcase of FIG. 1 having an oil passage and a cavity in accordance with the invention.

A detail view in cross section along the valley structure 106 of the crankcase 100 shown in FIG. 1 is shown in FIG. 3. The passage 118 is shown to span through the crankcase 100, fluidly connecting a front end 302 of the crankcase to a rear end 304. An inlet opening 306 of the passage 118 may be connected to an oil pump (not shown) that is arranged to induce a flow of oil in the passage 118 during operation of an engine. Oil in the passage 118 may be communicated to various engine components (not shown) through passages fluidly communicating with the passage 118. For example, a turbocharger oil supply passage 307 may be used to route oil to a center housing of a turbocharger (not shown), a plurality of main-bearing lubrication passages 308 may fluidly connect the passage 118 with each of a plurality of main bearing surfaces 310 in the crankcase 100 and may be used to lubricate a plurality of main bearings (not shown), and/or a plurality of piston cooling jet passages 312 may fluidly connect the passage 118 with a plurality of oil jets (not shown) that are arranged to impinge onto a plurality of pistons (not shown) included in the crankcase 100. These and other passages may tap into the passage 118 to supply oil to these and other engine components.

Figure 4:
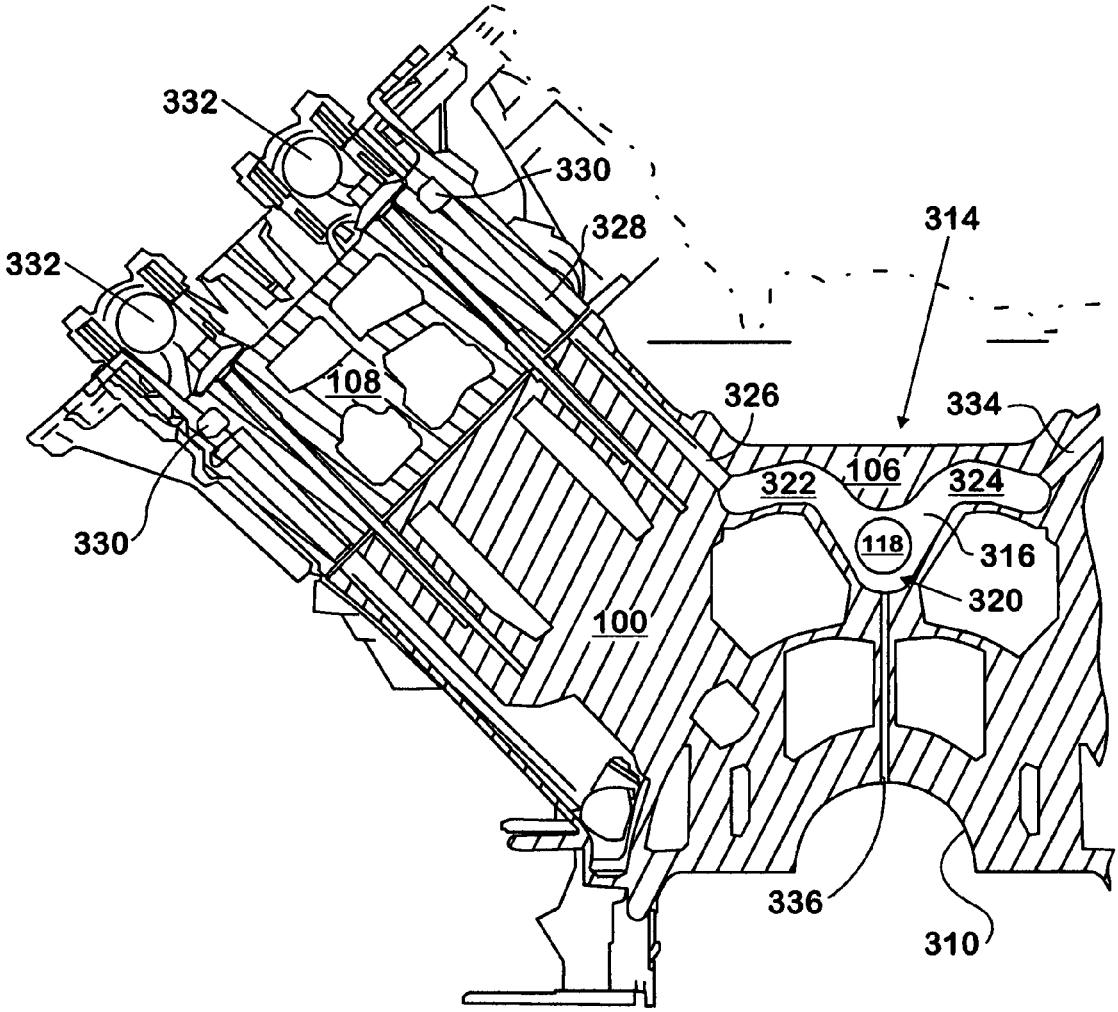
FIG. 4 is a detail cross-section view of a fluid passage intersection having an open cavity in accordance with the invention.

An intersection 314 that is integrated in the crankcase 100 includes a cavity 316. The cavity may have a peripheral surface 318 and include an inlet portion 320 and an outlet portion 322. The inlet portion 320 may be adjacent to an outlet 324 of the passage 118. A cross-section view of the intersection 314 is shown in detail in FIG. 4. The intersection 314 as shown is configured for the crankcase 100 that has a "V" configuration. The outlet portion 322 and an additional outlet portion 324 are fluidly communicating with the inlet portion 320 and are arranged to receive fluid therefrom coming from the passage 118 during operation of the engine. The cylinder head 108 is shown in cross-section connected to the crankcase 100. A left-bank cylinder head supply passage 326 is fluidly connected to the intersection 314 at the outlet portion 322. The passage 326 may also fluidly communicate with a cylinder head passage 328, which in turn may be fluidly connected to a cylinder head fluid distribution passage 330. The passage 330 in the cylinder head 108 may be used to distribute oil for to various engine components, for example, to one or more over-head-cam bearings 332.

The intersection 314 may also be fluidly connected to a right-bank cylinder head supply passage 334 at the additional outlet portion 324, which in turn may be used to supply a right-hand cylinder head (not shown). A bearing supply passage 336 may be fluidly connected to the intersection 314 at the inlet portion 320 and fluidly connect the intersection 314 with one of the main bearing surfaces 310 of the crankcase 100.

The cavity 316 of the intersection 314 may advantageously be formed during a casting operation that forms the crankcase 100. The cavity 316 may advantageously be open toward the rear end 304 of the crankcase 100 to facilitate removal and cleaning of any mold material from the cavity 316 after formation of the crankcase 100 is complete. The cavity 316 may advantageously have a "gull-wing" shape to provide a fluid communication passage between the main supply conduit 118 that is located close to a center of the valley structure 106 with the supply passages 326 and 334 that may be located close to laterally distal ends of the crankcase 100 more efficiently.

Use of the cavity 316 as part of the intersection 314 is advantageous because, first, all or most drilling operations used to form each passage 326, 334, and 336 are "open", meaning that a drilling location and depth is easily controlled to ensure a proper location of the drill and depth of the drilling operation because the intersection 314 is external to the crankcase 100 and readily visible. Second, there is no need to perfectly align the drills used to form each passage 326, 334, and 336 to coincide at one point as was previously required, because each drilling operation advantageously terminates in the cavity 316 thus providing a larger margin for misalignment and avoids the introduction of sharp edges and reductions in flow area of each passage 326, 334, and 336. Third, wear on the tooling used to drill each passage is reduced due to the decreased extent of drilling required to complete each crankcase 100. These and other advantages may be realized by use of an intersection configuration as described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A component having a fluid passage intersection, comprising:

a supply passage formed in the component;

a cavity in fluid communication with the supply passage;

at least one outlet passage formed in the component, wherein the at least one passage is in fluid communication with the cavity;

wherein the component is a crankcase for an engine, wherein the crankcase has a V-configuration, and wherein the cavity has a gull-wing shape.

2. A crankcase for an internal combustion engine, comprising:

an integrated oil passage formed therein having a plurality of distribution passages fluidly connected thereto;

a cavity formed therein in fluid communication with the integrated oil passage, wherein at least two of the plurality of distribution passages are fluidly connected to the integrated oil passage through the cavity;

wherein the cavity is an open cavity that is formed during a casting operation used to form the crankcase;

wherein the crankcase has a V-configuration, and wherein the cavity has a gull-wing shape.

3. A method for manufacturing a component, comprising the steps of:

casting a component and forming a cavity therein;

drilling at least one fluid passage in the component that fluidly communicates with the cavity;

drilling an additional fluid passage in the component that fluidly connects to the at least one fluid passage through the cavity;

wherein the cavity if formed in the component in a gull-wing shape.

* * * * *